US006029130A

United States Patent [19]

Ariyoshi

[11] Patent Number: 6,029,130

[45] Date of Patent: Feb. 22, 2000

[54] INTEGRATED ENDPOINT DETECTION FOR IMPROVED SPEECH RECOGNITION METHOD AND SYSTEM

[75] Inventor: Takashi Ariyoshi, Yokohama, Japan

[73] Assignee: Ricoh Company, Ltd., Japan

[21] Appl. No.: 08/915,102

[22] Filed: Aug. 20, 1997

[30] Foreign Application Priority Data

Aug. 20, 1996 [JP] Japan ..... 8-218702

[51] Int. Cl.[7] ..... G10L 5/00

[52] U.S. Cl. ..... 704/248; 704/247; 704/252; 704/253

[58] Field of Search ..... 704/247, 248, 704/252, 253, 239

[56] References Cited

U.S. PATENT DOCUMENTS

| | | | |
|---|---|---|---|
| 4,049,913 | 9/1977 | Sakoe | 704/239 |
| 4,052,568 | 10/1977 | Jankowski | 704/233 |
| 4,581,755 | 4/1986 | Sakoe | 704/247 |
| 4,667,341 | 5/1987 | Watari | 704/239 |
| 4,731,845 | 3/1988 | Matsuki et al. | 704/239 |
| 4,882,755 | 11/1989 | Yamada et al. | 704/239 |
| 4,918,731 | 4/1990 | Muroi | 381/43 |
| 5,220,609 | 6/1993 | Watanabe et al. | 704/248 |
| 5,774,851 | 6/1998 | Miyashiba et al. | 704/247 |

FOREIGN PATENT DOCUMENTS 6-105400 5/1990 Japan .

OTHER PUBLICATIONS

Lawrence Rabiner, Biing–Hwang Juang, Fundamentals of Speech Recognition, Pattern–Comparison Techniques, Chapter 4, pp. 141–149, 280–282, 1993.

Tatsuya Kimura, Katsuyuki Niyada, Shoji Hiraoka, Shuji Morii and Taisuke Watanabe, A Telephone Speech Recognition System Using Word Spotting Technique Based on Statistical Measure, Dallas 1987.

*Primary Examiner*—David R. Hudspeth
*Assistant Examiner*—Daniel Abebe
*Attorney, Agent, or Firm*—Knoble & Yoshida LLC

[57] ABSTRACT

A method and a system recognize speech based upon an approach which combines certain advantages of speech detection and word spotting for improved accuracy without sacrificing efficiency. The improved method and system is based upon the determination of a total similarity value based upon a cumulative value and power information at or substantially near a terminal frame.

51 Claims, 8 Drawing Sheets

INTEGRATED ENDPOINT DETECTION FOR IMPROVED SPEECH RECOGNITION METHOD AND SYSTEM

FIELD OF THE INVENTION

The current invention is generally related to a speech recognition method and system, and more particularly related to a method and a system for recognizing speech based upon an approach which combines certain advantages of speech detection and word spotting for improved accuracy without sacrificing efficiency.

BACKGROUND OF THE INVENTION

According to one approach of speech recognition, a speech portion must be determined and separated from input voice data. The speech portion generally includes words that is uttered by a human. In one example of the endpoint detection, the speech portion is processed so as to extract a predetermined characteristics based upon parametric spectral analyses such as a linear predictive coding (LPC) melcepstrum. The selected speech portion or a series of frames is compared to a predetermined set of standard patterns or templates in order to determine a distance or similarity between them. Speech is thus recognized based upon similarity.

The above described process critically depends upon the accurate detection and separation of the speech portion or words. However, the input voice data often includes other noises such as overlapping background noise in addition to the human speech. Human speech itself also contains variable speech elements due to undesirable noises such as a mouth click, dialects and individual differences even if the same words are uttered. Because of these and other reasons, it has been difficult to correctly isolate speech elements in order to recognize human speech.

One prior art approach includes endpoint detection as disclosed in "Fundamentals of Speech Recognition," L. Rabiner and B. H. Juang (1993). In general, in order to determine end points, an input speech signal is first processed and feature measurements are made. Then, the speech-detection method is applied to locate and define the speech events. Lastly, the isolated speech elements are compared against the speech templates or standard speech patterns. In other words, a start and an end of each speech element are determined prior to the pattern matching step. Although this approach is functional when the input speech lacks background noise or contains relatively minor non-speech elements, speech recognition based upon the above described explicit endpoint detection deteriorates with a high level of background noise. Background noise erroneously causes to define a start or an end of speech events.

In order to improve the above described problem, another prior art approach includes a word spotting technique as disclosed in "A Robust Speech Recognition System Using Word-Spotting With Noise Immunity Learning," Takebayashi, et al., pgs. 905–908, IEEE, ICASSP (1991). In general, word spotting generally does not rely upon a particular pair of speech event boundaries. In other words, in a pure word spotting approach, all possible beginnings and endings are implicitly selected and are considered for the pattern-matching and recognition-decision process. For example, a continuous dynamic programming matching technique (a DP matching) continuously adjusts input data in the time domain to enhance matching results, "Digital Voice Processing," Furui (1995). In the word spotting approach, although the common background noise problem is substantially reduced, certain background sound may be confused with certain speech such as a nasal sound when a characteristic value such as melcepstrum is used for recognition. Furthermore, since a large number or all possible endpoint candidates are examined, the amount of calculation is burdensome and affects a performance level.

In addition to the above described spectral analyses, the energy level of the input voice data is combined to improve the accuracy. The energy level appears as power or gain in the speech spectral representation. The energy information has been incorporated into every spectral value or every frame as discussed in "Fundamentals of Speech Recognition," L. Rabiner and B. H. Juang (1993).

Despite the above described use of the energy information, the accuracy of the speech recognition remains to be desired. The energy level, however, is not generally an accurate indication since the energy level as a characteristic value is variable among individuals and over time. In fact, the incorporation of the energy information into every frame tends to cause a large degree of error by cumulating inaccurate energy information. The problem in word spotting occurs when the energy level of the speech input is relatively low but when the spectral information of background resembles speech.

SUMMARY OF THE INVENTION

In order to solve the above described and other problems, according to a first aspect of the current invention, a method of recognizing speech, including the steps of: a) inputting input voice data having a plurality of frames, each of the frames having a predetermined frame length; b) continuously generating a first frame signal for each of the frames, the first frame signal being indicative of a first feature of a corresponding one of the frames; c) continuously comparing the first frame signal to a predetermined set of standard signals and generating a similarity signal indicative of a degree of similarity between the first frame signal and one of the standard signals; d) cumulating the similarity signal over a plurality of the frames so as to generate a cumulative similarity signal; e) generating a second frame signal indicative of a second feature of a portion of the frames; f) adding the cumulative similarity signal the second frame signal so as to generate a total similarity signal; and g) recognizing the frames as speech based upon the total similarity signal.

According to a second aspect of the current invention, a system for recognizing speech, including: a voice input unit for inputting input voice data having a plurality of frames, each of the frames having a predetermined frame length; a first voice analysis unit connected to the voice input unit for continuously generating a first frame signal for each of the frames, the first frame signal being indicative of a first feature of a corresponding one of the frames; a similarity determination unit connected to the first voice analysis unit for continuously comparing the first frame signal to a predetermined set of standard signals and generating a similarity signal indicative of a degree of similarity between the first frame signal and one of the standard signals, the similarity determination unit cumulating the similarity signal over a plurality of the frames so as to generate a cumulative similarity signal; a second voice analysis unit connected to the voice input unit for generating a second frame signal indicative of a second feature of a portion of the frames; a end portion control unit connected to the second voice analysis unit for controlling a further addition of the second frame signal to the cumulative similarity signal in the similarity determination unit, the similarity determination unit generating a total similarity signal; and a speech confirmation unit connected to the similarity determination unit for confirming the frames as speech based upon the total similarity signal and for generating a speech confirmation signal.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
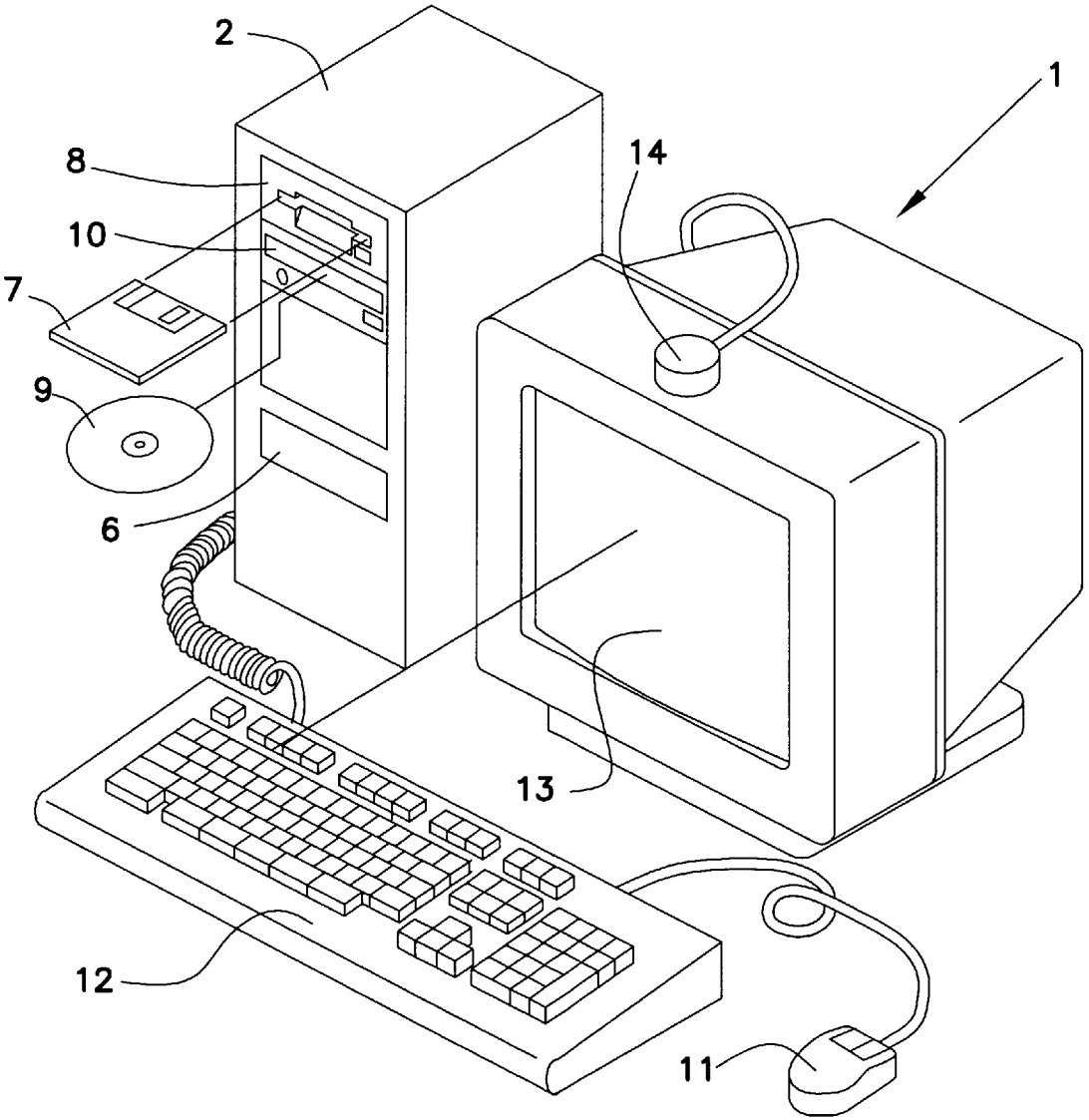
FIG. 1 illustrates a perspective view of the endpoint detection system for improved speech recognition according to the current system.

Referring now to the drawings, wherein like reference numerals designate corresponding structure throughout the views, and referring in particular to FIG. 1, one preferred embodiment of the enhanced speech recognition system according to the current invention is illustrated. This preferred embodiment includes a microphone 14 which inputs human speech or voice data into the enhanced speech recognition system 1. Other input devices such as a keyboard 12 and a mouse 11 are illustrated to indicate that the enhanced speech recognition system 1 can be implemented using a general purpose computer. A central processing unit 2 runs software or a predetermined computer program which processes the input voice data to recognize the speech components as words. The recognized speech is displayed in a display unit 13. In addition to an internal data storage unit such as a hard disk and a hard disk drive, the central processing unit 2 also accesses the computer program stored in a floppy disk 7 via a floppy disk drive 8 or in a compact disk (CD) via a CD drive. The computer program may be either a part of application software or an operation system software. If the recognition software is provided as an application program, each application program is tailored to requirements of each application. Furthermore, an appropriate form of speech recognition software may be downloaded from a host or central storage area via computer network.

Figure 2:
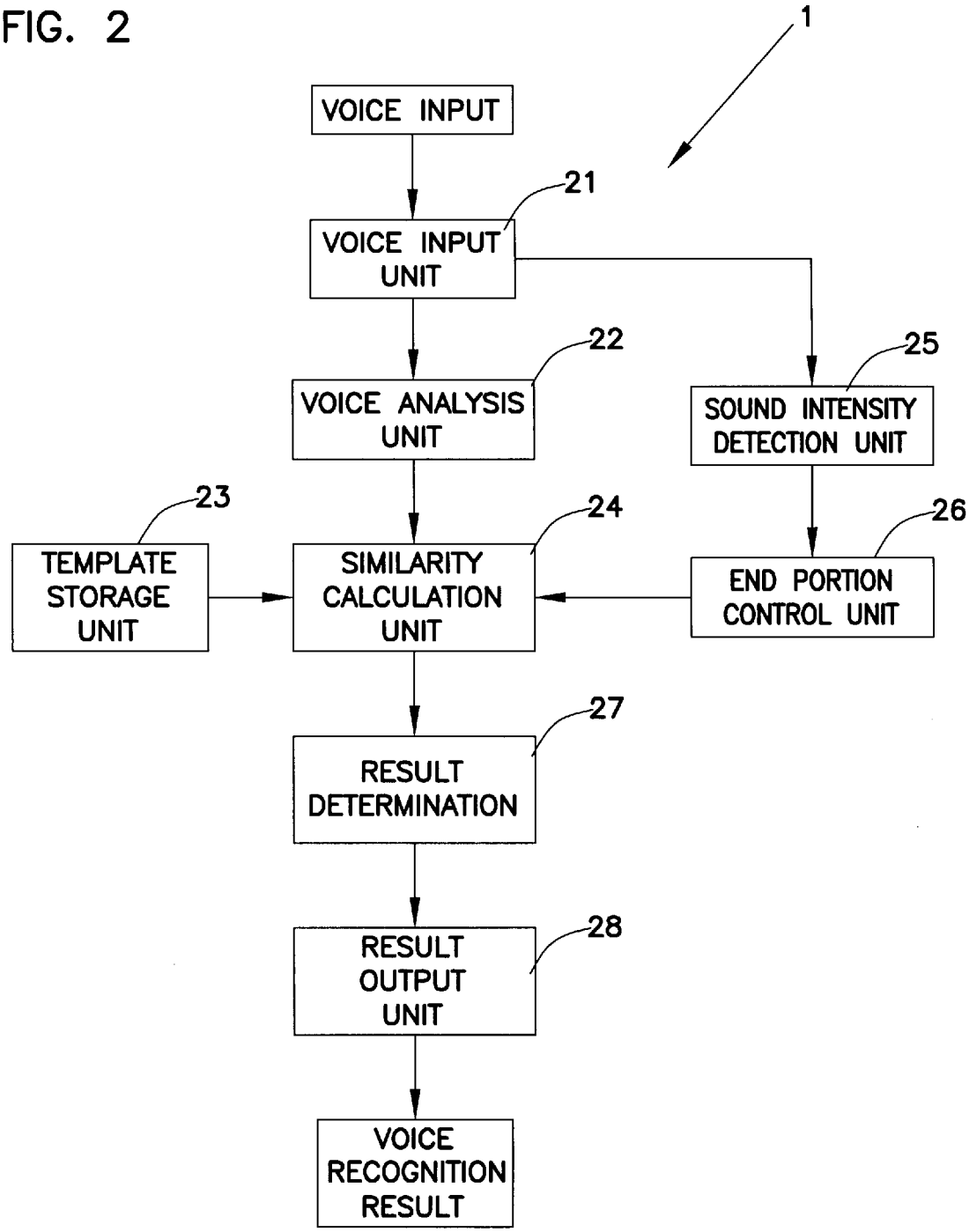
FIG. 2 diagrammatically illustrates components of one preferred embodiment of the current system according to the current invention.

Referring to FIG. 2, one preferred embodiment of the above described enhanced speech recognition system is further illustrated to describe additional components. A voice input is inputted via a voice input unit 21 and is broken down into frames or input voice data units. Each of these frames is simultaneously analyzed by a voice analysis unit 22 and a voice intensity detection unit 25. The voice analysis unit or a first voice analysis unit 22 generates spectral analysis data or a first frame signal while the voice intensity detection unit or a second voice analysis unit 25 determines the voice energy information of the voice input or a second frame signal. A similarity calculation or determination unit 24 compares the spectral data against a set of standard patterns or templates stored in a template storage unit 23. The similarity determination unit 24 generates a similarity signal or a vector distance indicative of a degree of similarity for each frame for each state of each potential word. The similarity determination unit 24 accumulates the similarity signal values corresponding to a plurality of consecutive frames thereafter and generate a cumulative similarity signal. The similarity determination unit 24 continues to add the similarity signals until it sufficiently determines that the consecutive frames represent a word or a phrase. Certain components of the above described system are implemented either in software or hardware and also in an application specific integrated circuit.

Still referring to FIG. 2, an end portion control unit 26 sends the similarity determination unit 24 the second frame signal indicative of the energy information. The corresponding to only the first and last frame and or a predetermined number of frames substantially near the first and last frame. The similarity determination unit 24 in turn adds the second frame signal to the cumulative similarity signal corresponding to only the first and last frame and or a predetermined number of frames substantially near the first and last frame and generates a total similarity signal for each potential word candidate. More precisely, the second frame signal is added only when a state is determined to be in a beginning or ending state of a predetermined state transition model or template. In response to the total similarity signal, a result determination or speech confirmation unit 27 compares the total similarity signal to a predetermined threshold value in order to confirm that a speech element as defined by the identified boundary represents the previously determined word. Upon confirmation, a result output unit 28 outputs the confirmed voice recognition result to an output unit such as a display unit.

According to one preferred embodiment of the enhanced speech recognition system according to the current invention, the above described first frame signal is generated based upon linear predictive coding melcepstrum under the following conditions. A window function is Hamming window. The windowing and the frame shift are 20 millisecond while the LPC analysis order, the mel-scaling parameter and the dimension of LPC derived melcepstrum vector are respectively 20, 0.5 and 10.

Figure 3:
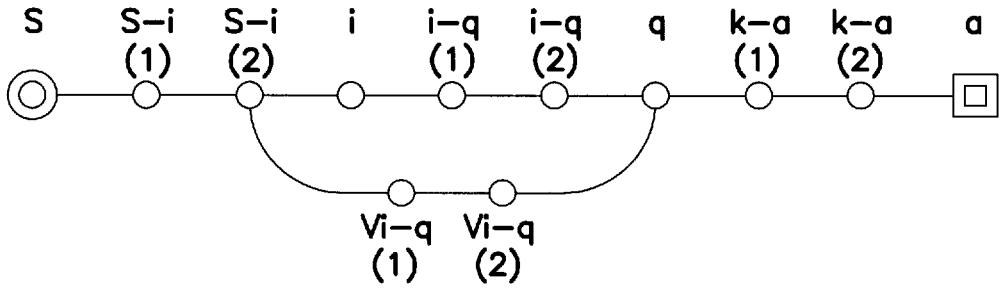
FIG. 3 is a state transition diagram of an exemplary word.

Referring to FIG. 3, according to one preferred embodiment of the enhanced speech recognition system according to the current invention, the above described template storage unit 23 is a data file containing data representing a state transition model for each phoneme and a phoneme network for each word. In general, the network includes a automaton or a state machine for vowels such as /a/, /i/ etc., consonants such as /k/, /s/, etc as well as phoneme transitions such as /s-a/, /a-s/ and so on. One preferred embodiment of the recognition dictionary contains about 200 sound elements, and each sound element has at most two states. Each state is defined by an averaged characteristic value and a duration time of the state as disclosed in U.S. Pat. No. 4,918,731. One example of a Japanese word "shika" meaning deer is illustrated in the above described data representation. From a start "S" to a first state S to a second state S-i(2), there is no branching. However, the second state S-i(2) leads to a first path including Vj-q(1) and Vi-q(2) which represent silent vowel for "i" and ending at a silent state "q" and a second path including states i, i-q(1), and i-q(2) and also ending at the silent state "q." The two paths are joined at the silent state "q" and leads to an end "a" through states k-a(1) and k-a(2).

Figure 4A:
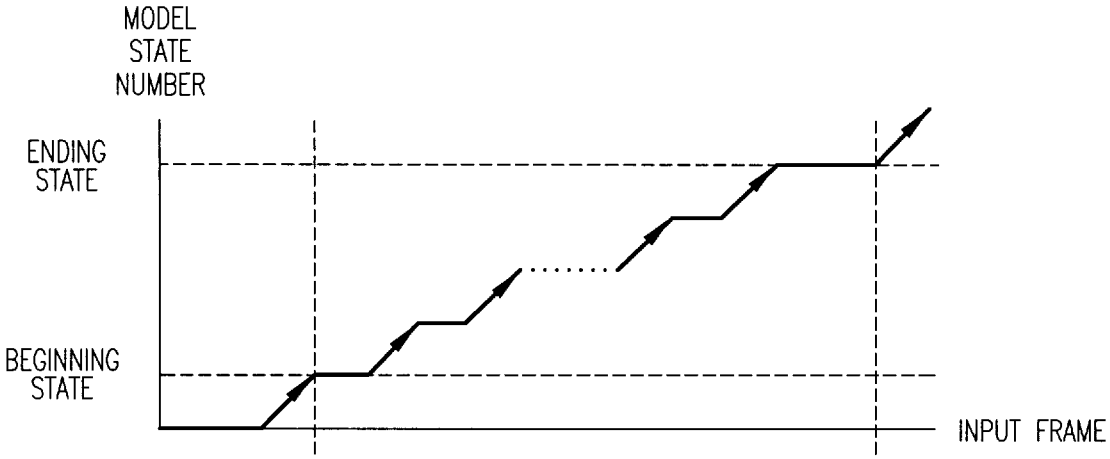
FIGS. 4A and 4B are respectively a first graph illustrating a cumulative similarity value of an exemplary input over frames and a second graph illustrating intensity or energy information of an example over the corresponding frames.
Figure 4B:
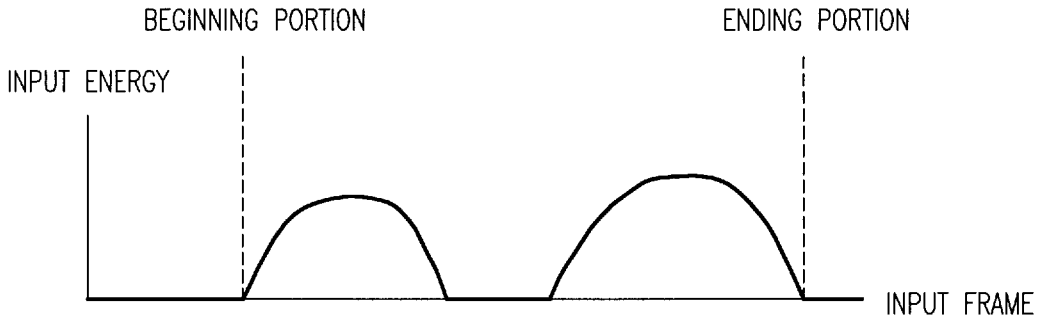

Now referring to FIGS. 4A and 4B, the above described steps of cumulating similarity signal values over frames are illustrated using an example. As noted before, for each frame of the input voice data, a similarity signal is generated, and its value is cumulatively added. The X-axis of FIGS. 4A and 4B indicates a frame number of the input voice data. The Y-axis of FIG. 4A indicates the states while that of FIG. 4B indicates a power or intensity of the input voice data. As the frame number increases from left to right on the X-axis, FIG. 4A shows a state transition model for each phoneme. On the other hand, FIG. 4B shows that the power or intensity value locally increases in certain frames corresponding to the utterance of the exemplary word.

Figure 5:
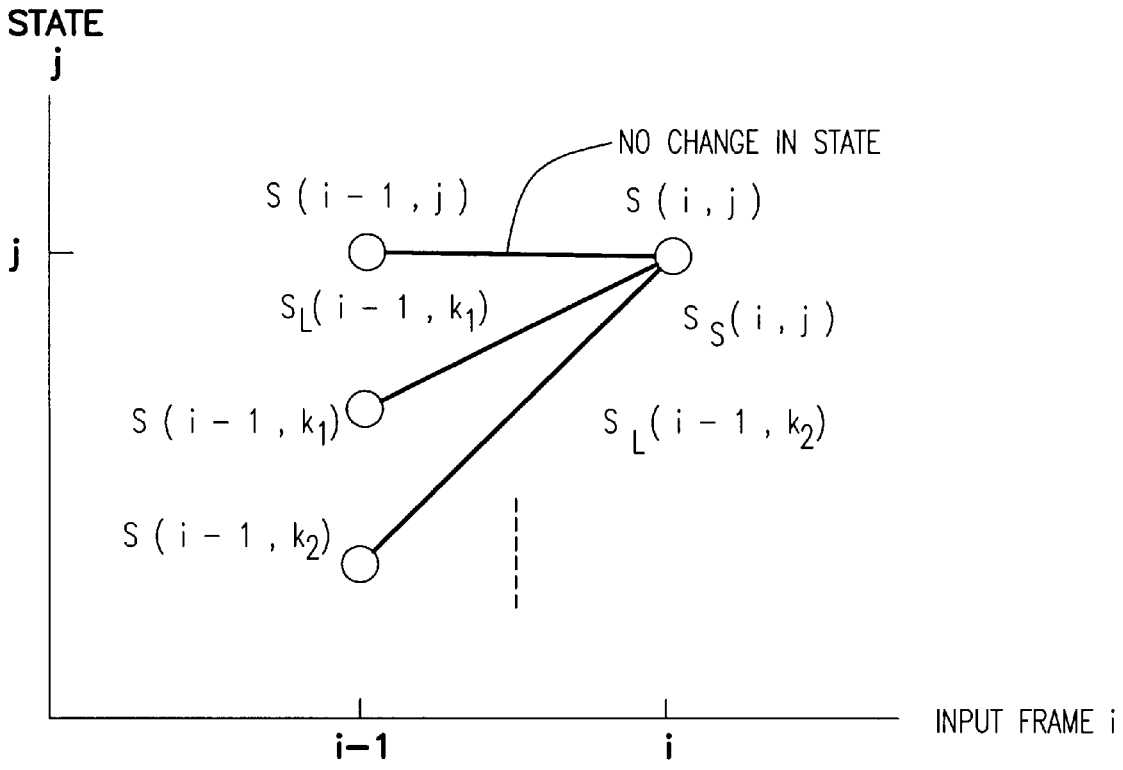
FIG. 5 is a graph illustrating potential state transitions of an exemplary input from one frame to the next.

Now referring to FIG. 5, in determining a cumulative similarity value, a similarity signal must be generated for each frame of the input voice data. However, in order to determine the similarity value local to each frame, additional steps are performed for certain input voice data which requires comparisons to standard patterns containing branching paths. The X-axis indicates a frame number i of the input voice data while the Y-a axis indicates a state j at the frame number i. In this illustrative example, at an frame i−1, there are three possible states S(i−1,j), S(i−1,k1) and S(i−1,k2). From these potential states, at a next frame i, they move to a state S(i,j). The transition from S(i−1,j) to S(i,j) does not involve a change in the state while other two transitions include a state transition. In determining a local similarity value $S_S(i,j)$, the above described three possible transitions are considered to determine the best possible match before adding the selected local similarity value.

Still referring to FIG. 5, the above described steps are also summarized in the following equation for determining a cumulative similarity value S(i,j):

$$S(i,\ j) = S_s(i,\ j) + \max_k((S(i-1,\ j),\ (S(i-1,\ k) + s_L(i-1,\ k)))$$

where k ϵ parents nodes of j. a local similarity value $S_S(i,j)$ at i,j is added to a largest of the values among S(i−1, j) and $S(i-1,k)+s_L(i-1,k)$ where k is a variable having a value of k1 and k2. When a state transition is involved, the term, $s_L(i-1,k)$ represents a duration-based transition signal for indicating a similarity based upon an amount of time. The local similarity value is further defined by the following equation:

$$S_S(i,j)=W_S(B-d_S(i,j))$$

where $W_S$ is a weight for a spectral similarity for each state and ranges from 0.2 to 1.0; B is a middle point of the spectral similarity for each state and ranges from 0.5 to 1.5 according to one preferred embodiment; $d_S$ is an Euclid distance for determining a local similarity. Similarly, a duration-based similarity is further defined by the following equation:

$$S_L(i,j)=W_L d_L(i,j)$$

where $W_L$, is a weight for a duration-based similarity for each state and ranges from 0.0 to 0.1 according to one preferred embodiment. $d_L$ is an Euclid distance for determining a local duration-based similarity.

The above described cumulative similarity value is further processed to determine a total similarity value based upon a penalty value or a second frame signal value for beginning and ending transitions of the input voice data. In general, the penalty value or a second frame signal value is negative and calculated based upon a predetermined characteristics such as input voice intensity for every frame. In the alternative, the penalty value is determined based upon the same characteristic for every frame. According to one preferred embodiment of the current invention, the penalty value or the second frame signal value $P_{S/E}$ is determined by the following equation:

$$\begin{aligned} p_2 \le p(i) &\rightarrow P_{S/E}(i) = 0 \\ p_1 \le p(i) < p_2 &\rightarrow P_{S/E}(i) = -P_p(p_2 - p(i))/(p_2 - p_1) \\ p(i) < p_1 &\rightarrow P_{S/E}(i) = -P_p \end{aligned}$$

where $p(i)=\log_2(\text{intensity})$ and $p_1$, $p_2$ and $P_p$ are predetermined positive constants. Exemplary values of these constants are $p_1=10$, $p_2=14$ and $P_p=3$.

At a beginning frame i, when a cumulative similarity is s(i−1, k), a penalty at the beginning frame $P_S(i)$ is calculated to be s(i−1, k) assuming that $P_S \leqq 0$ and k is a beginning node. Similarly, a total similarity value Sim(i) at an ending frame i is defined as follows:

$$Sim(i) = \max_k S(i-1,\ k) + P_E(i)$$

where k is an ending node indicated by double rectangles in FIG. 3, and $P_E(i) \leqq 0$.

In summary, for each frame i, there are M potentially recognized words, and m ranges from 0 to M−1 for a particular word. For each m word, there are J(m) states, and j ranges from 0 to J(m) for a particular state. Based upon the above notations, a similarity value for each frame for each state in every potential word is expressed by S(m,i,j). Similarly, a total similarity value for each frame for every potential word is expressed as Sim(m,i).

Finally, when a total similarity value Sim(m1,i) exceeds a predetermined threshold "Th," it is waited to see if other candidates Sim(m,ii) exceed Sim(m1,i) for a predetermined number of frames ii ranging from i to i+N where N is a predetermined constant. According to one preferred embodiment, the predetermined constant ranges from 15 to 30. If the total similarity value Sim(m1,i) is exceeded by another total similarity value Sim(m,ii) within the predetermined number of frames, the total similarity value Sim(m,ii) replaces Sim (m1,i) and the above described processes are repeated for i to i+N. On the other hand, if the total similarity value Sim(m,ii) fails to exceed the total similarity value Sim(m1,i) after the predetermined number of frames, the total similarity value Sim(m1,i) is confirmed, and a corresponding standard word m1 is outputted as a result of speech recognition.

Because of the above-described adjustment in confirming the speech recognition in response to an input energy level, the noise portions associated with a small energy level are generally prevented from being erroneously recognized as a part of speech using an endpoint free word spotting technique. In addition, since the path selection in the above-described matching process is merely controlled but not solely determined based upon the energy level, if the total similarity value of a potential word is sufficiently high, the word is correctly recognized despite a low energy level. Furthermore, even when the input signal changes in an overall fashion, although the confirmation in matching is somewhat affected, the speech word recognition is substantially improved due to the total similarity value of the word.

Figure 6:
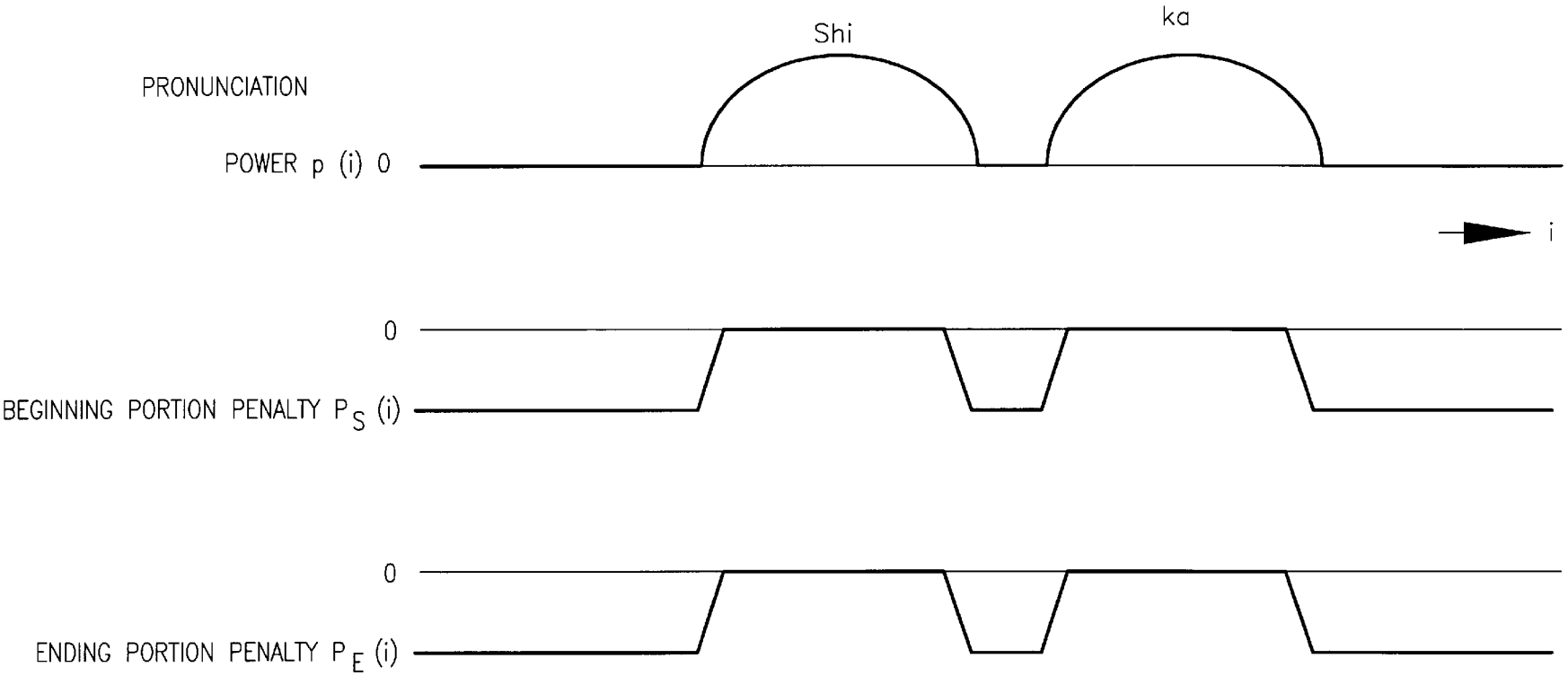
FIG. 6 illustrates relationships among intensity, a beginning penalty value and an ending penalty value of an exemplary input.

Now referring to FIG. 6, according to one preferred embodiment of the current invention, a penalty value at a beginning portion $P_S(I)$ and a penalty value at an ending portion $P_E(I)$ are zero. In other words, the energy level is high.

Figure 7:
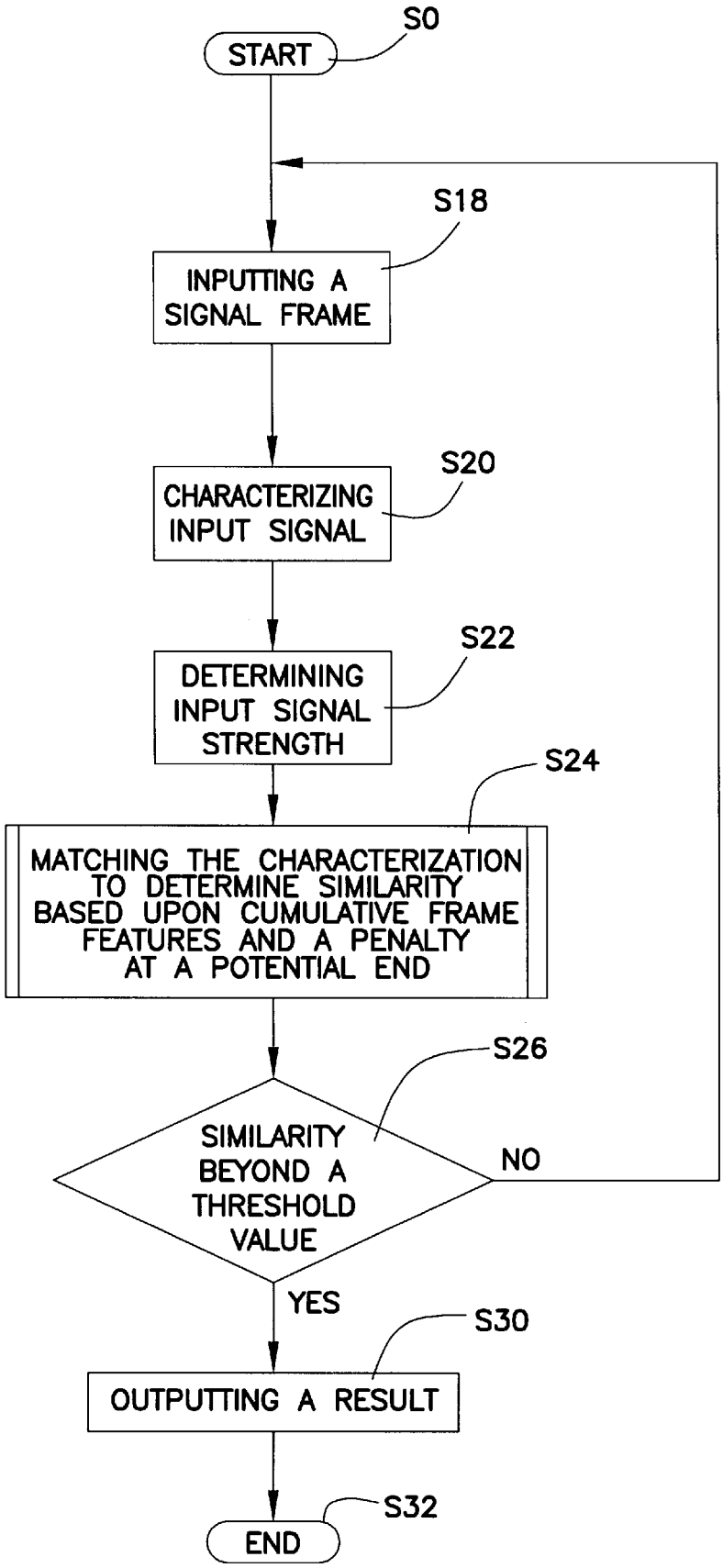
FIG. 7 is a flow chart illustrating steps involved in one preferred method of the improved speech recognition according to the current invention.

Referring to FIG. 7, a flow chart illustrates certain steps involved in practicing the current invention. From a start in a step S0, data for a single frame is inputted at a time in a step 18, and a first frame signal or a characterization signal such as melcepstrum is generated for each frame of input voice data in a step S20. In a step 22, a second frame signal or an intensity signal for each frame is also determined. Although this flow chart illustrates that the step S22 follows the step S20, in an alternative process of the current invention, these steps are simultaneously performed. In a step S24, in certain instances where branching patterns are involved, a best matched similarity value is selected from a standard set. The above determined first frame signal or a similarity value is cumulated over a plurality of frames to generate a cumulative similarity value. A penalty signal or a second frame signal is generated. This signal indicates a penalty value based upon the intensity or power of the frame. The penalty value is added to the cumulative similarity value to generate a total similarity value. In a step S26, the total similarity value is compared to a predetermined threshold value. The confirmed result is outputted in a step 30, and the process is ended in a step 32.

Figure 8:
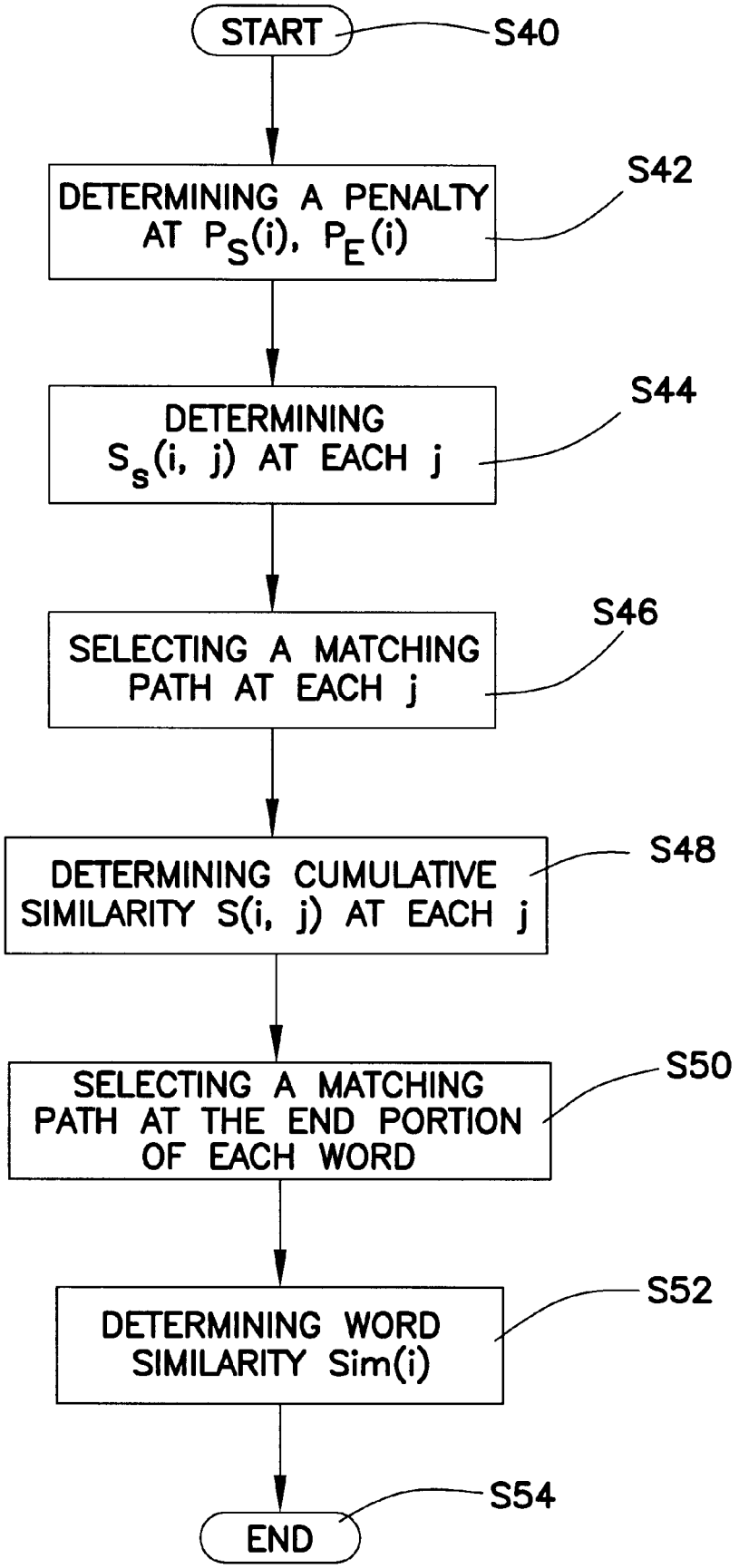
FIG. 8 is a flow chart illustrating certain detailed teps involved in one preferred method of the improved speech recognition according to the current invention.
Figure 9:
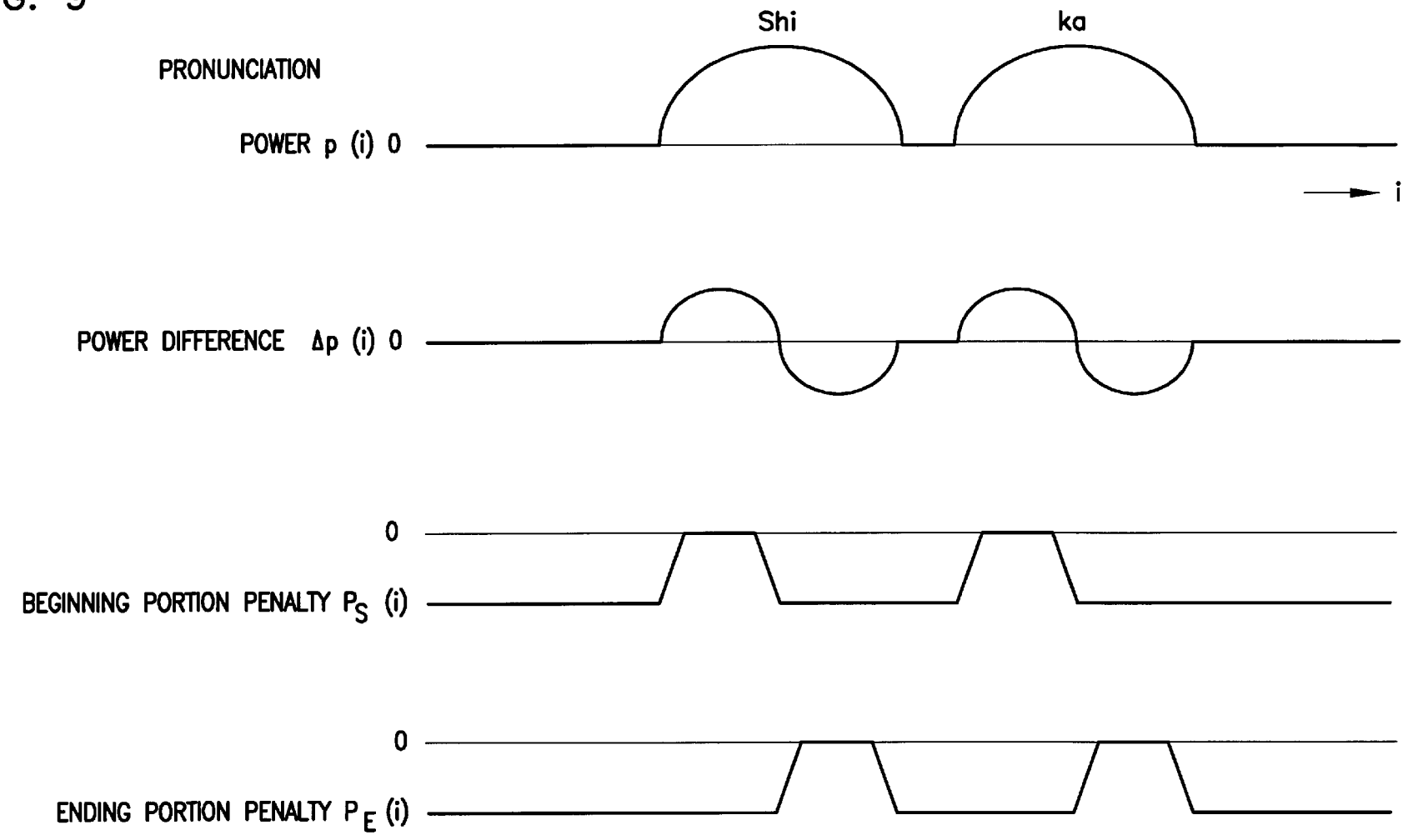
FIG. 9 illustrates relationships among intensity, a difference in intensity, a beginning penalty value and an ending penalty value of an exemplary input.

Now referring to FIG. 8, the above described step S24 are further described in detail. In the step S24, j=0 indicates a transition to an initial state. In a step S42, a penalty value at a beginning frame $P_S(i)$ and at an $P_E(i)$ are determined. In a step S44, a local similarity value $S_S(i,j)$ for each state j is determined for each frame i, and the best match is selected among the branching paths in a phoneme network of a standard set of patterns in a step S46. Thus, in a step S48, a cumulative similarity value is generated including the above described branching pattern. Finally, in steps S50 and S52, at an ending frame, in addition to the above described matching path selection, a penalty value is added to the cumulative similarity value, and a total similarity value Sim(i) for each word is determined. As described above with respect to FIG. 7, the phrase or word is confirmed, and the confirmed result is outputted before the process is ended.

Because of the above described selected use of power or intensity in the input voice data at or substantially near the beginning and or the ending, the voice energy information clarifies the speech without sacrificing efficiency. In other words, the voice energy information is used to supplement other voice characteristic information such as spectral signal rather than independently recognizing the speech. This clarifying nature of the penalty signal improves the accuracy for recognizing the speech in noisy environment. In other words, the background noise is not likely to cause an error in speech recognition since the energy information is only used at or near the terminal frames. In this regard, one application example of the current improved speech recognition system is an automobile navigation system since the installed environment generally includes a relatively high level of background noise. A driver tell the system a destination while he or she is driving, and the navigation system audiovisually guides the driver to the destination. Another application example includes computer games or entertainment which may be situated in noisy environment.

In alternative embodiments of the improved speech recognition system according to the current invention, the following variations are considered. In the above described preferred embodiment according to the current invention, a single frame either at a beginning or at an end is generally used for the above described penalty value in order to improve speech recognition. In contrast, in one alternative embodiment, in addition to a terminal frame, a predetermined number of frames near the terminal frame is used to further improve the use of the voice energy information in determining the penalty value. For example, the energy information from the plurality of frames is averaged to determine the penalty value.

Another alternative embodiment uses a difference among these consecutive frames near the terminal as further described by the following equations. $\Delta p(i)$ is defined as a difference between the p(i) and the p(i−1). $P_E(i)$ is a penalty value at or substantially near the end frame.

$$\begin{aligned} -p_2 \geq \Delta p(i) &\rightarrow P_E(i) = 0 \\ -p_1 \geq \Delta p(i) > -p_2 &\rightarrow P_E(i) = -P_p(p_2 - \Delta p(i))/(p_2 - p_1) \\ \Delta p(i) > -p_1 &\rightarrow P_E(i) = -P_p \end{aligned}$$

where $p_1$, $p_2$ and $P_p$ are predetermined constants. One exemplary set of these positive constants includes $p_1=2$, $p_2=4$ and $P_p=4$. Similarly, $P_S(i)$ is a penalty value, and $P_S(i)$ is defined as follows.

$$\begin{aligned} p_2 \leq \Delta p(i) &\rightarrow P_S(i) = 0 \\ p_1 \leq \Delta p(i) < p_2 &\rightarrow P_S(i) = -P_p(p_2 - \Delta p(i))/(p_2 - p_1) \\ \Delta p(i) < p_1 &\rightarrow P_S(i) = -P_p \end{aligned}$$

where $p_1$, $p_2$ and $P_p$ are predetermined constants. One exemplary set of these positive constants includes $p_1=2$, $p_2=4$ and $P_p=4$.

Yet another alternative embodiment according to the current invention uses the voice energy information to adjust a threshold value for selecting a matching path in determining a local similarity value. In other words, for determining a beginning frame, a duration based is adjusted to become negative while for determining an end frame, a threshold value is adjusted.

In particular, $P_S(i)$ generally becomes 0 when the voice energy level is relatively increasing while $P_E(i)$ becomes 0 when the voice energy level is relatively decreasing. In other words, the above described penalty signal $P_S(i)$ substantially prevents a frame having a decreasing voice energy level from being recognized as a beginning frame. By the same token, the above described penalty signal $P_E(i)$ substantially prevents a frame having a increasing voice energy level from being recognized as an ending frame. These features improve the detection of the speech especially in environment where the spectral information of background noises resemble speech. Furthermore, when penalty values are determined based upon differential among a plurality of frames, even though an overall voice intensity level is altered, penalty values remain substantially the same. This observation has a practical benefit for variable input intensity levels which are caused by individual differences in speech volume as well as a distance between an input device such as a microphone and a speaker.

One exemplary comparison between the above described speech recognition results according to the current invention and a conventional speech recognition results is shown below.

| | Correct Recognition % | | |
|---|---|---|---|
| | Male | Female | Total |
| Conventional | 93.0 | 89.9 | 91.3 |
| Absolute | 95.9 | 95.2 | 95.5 |
| Differential | 97.0 | 95.4 | 96.2 |

"Absolute" refers to one preferred embodiment which determines the penalty value based upon input voice data from a single frame. "Differential" refers to another preferred embodiment which determines the penalty value based upon a difference in energy level input voice data between or among a predetermined number of frames. The above recognition results were obtained under the following conditions: Nine males and eleven females each uttered thirty geographical names twice in an isolated manner towards a non-directional microphone placed approximately 10 cm away from each of the speakers in a control office environment.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the full extent indicated by the broad general meaning of the terms in which the appended claims are expressed.

What is claimed is:

1. A method of recognizing speech, comprising the steps of:

a) inputting input voice data having a plurality of frames, each of said frames having a predetermined frame length;

b) continuously generating a first frame signal for each of said frames, said first frame signal being indicative of a first feature of a corresponding one of said frames;

c) continuously comparing said first frame signal to a predetermined set of standard signals and generating a similarity signal indicative of a degree of similarity between said first frame signal and one of said standard signals;

d) continuously generating a second frame signal for each of said frames, said second frame signal being indicative of a second feature of a corresponding one of said frames;

e) continuously cumulating said second frame signal corresponding to a predetermined combination from a set consisting of a beginning portion and an ending portion of said standard signals and said similarity signal over a plurality of said frames so as to generate a cumulative similarity signals; and f) recognizing said frames as speech based upon said cumulative similarity signal.

2. The method of recognizing speech according to claim 1 wherein a word spotting technique is used.

3. The method of recognizing speech according to claim 1 wherein said pedetermined set of said standard signals is a state transition model.

4. The method of recognizing speech according to claim 1 wherein said second feature is a likelihood for being an end point.

5. The method of recognizing speech according to claim 4 wherein said second frame signal increases a total similarity signal value for a frame with a likelihood for being the end point so that said frame is more likely selected as an end point using an end point free pattern matching.

6. The method of recognizing speech according to claim 4 wherein said second frame signal includes an intensity signal which is indicative of intensity of an i th one of said frames and is designated by p(i), said p(i) is defined by log based of said intensity at said i th one of said frames.

7. The method of recognizing speech according to claim 4 wherein said second frame signal includes a differential intensity signal which is indicative of differential intensity of an ith one of said frames and is designated by Δp(i) said Δp(i) being defined by a difference between p(i) at p(i−1).

8. The method of recognizing speech according to claim 1 wherein said step d) is continuously performed until said cumulative similarity signal in said step d) reaches a second predetermined threshold value.

9. The method of recognizing speech according to claim 6 wherein said second frame signal is a penalty value that becomes larger as said intensity becomes smaller.

10. The method of recognizing speech according to claim 7 wherein said second frame signal is a penalty value that becomes larger as said differential intensity becomes smaller for said beginning portion and as said differential intensity becomes larger for said ending portion.

11. The method of recognizing speech according to claim 6 wherein said p(i) at the beginning frame of said frames is designated by $P_S(i)$ and said p(i) at the end frame of said frames is designated by $P_E(i)$, said $P_S(i)$ and $P_E(i)$ being determined by a following set of relationships:

$$p_2 \le p(i) \quad \rightarrow P_{S/E}(i) = 0$$

$$p_1 \le p(i) < p_2 \quad \rightarrow P_{S/E}(i) = -P_p(p_2 - p(i))/(p_2 - p_1)$$

$$p(i) < p_1 \quad \rightarrow P_{S/E}(i) = -P_p$$

where $p_1$, $p_2$ and $p_p$ are predetermined constants.

12. The method of recognizing speech according to claim 7 wherein said Δp(i) at the beginning frame of said frames is designated by $P_S(i)$, said $P_S(i)$ being determined by a following set of relationships:

$$p_2 \le \Delta p(i) \quad \rightarrow P_S(i) = 0$$

$$p_1 \le \Delta p(i) < p_2 \quad \rightarrow P_S(i) = -P_p(p_2 - \Delta p(i))/(p_2 - p_1)$$

$$\Delta p(i) < p_1 \quad \rightarrow P_S(i) = -P_p$$

wherein $p_1$, $p_2$ and $P_p$ are predetermined constants.

13. The method of recognizing speech according to claim 7 wherein said Δp(i) at the end frame of said frames is designated by $P_E(i)$, said $P_E(i)$ being detennined by a following set of relationships:

$$-p_2 \geq \Delta p(i) \quad \rightarrow P_E(i) = 0$$

$$-p_1 \geq \Delta p(i) > -p_2 \quad \rightarrow P_E(i) = -P_p(p_2 - \Delta p(i))/(p_2 - p_1)$$

$$\Delta p(i) > -p_1 \quad \rightarrow P_E(i) = -P_p$$

wherein $p_1$, $p_2$ and $p_p$ are predeterninned constants.

14. The method of recognizing speech according to claim 1 wherein said first frame signal includes melcepstrum.

15. The method of recognizing speech according to claim 14 wherein said melcepstrum is determined under a predetermined set of conditions including said predetermined frame length of 20 millisecond and mel-scaling parameter of 0.5.

16. The method of recognizing speech according to claim 14 wherein said first frame signal further includes a duration-based state transition signal.

17. A method of recognizing speech, comprising:

a) inputting input voice data having a plurality of frames, each of said frames having a predetermined frame length;

b) continuously generating a first frame signal for each of said frames, said first frame signal being indicative of a first feature of a corresponding one of said frames;

c) continuously comparing said first frame signal to a predetermined set of standard signals and generating a similarity signal indicative of a degree of similarity between said first frame signal and one of said standard signals;

d) continuously generating a second frame signal for each of said frames, said second frame signal being indicative of a second feature of a corresponding one of said frames;

e) continuously cumulating said second frame signal corresponding to a predetermined combination from a set consisting of a beginning portion and an ending portion of said standard signals and said similarity signal over a plurality of said frames so as to generate said similarity signals;

f) recognizing said frames as speech based upon said similarity signal;

g) comparing said similarity signal to a predetermined threshold value; and h) repeating at least said steps b), c), d) and e) for a predetermined number of times after said frames are determined.

18. A system for recognizing speech, comprising:

a voice input unit for inputting input voice data having a plurality of frames, each of said frames having a predetermined frame length;

a first voice analysis unit connected to said voice input unit for continuously generating a first frame, signal for each of said frames, said first frame signal being indicative of a first feature of a corresponding one of said frames;

a similarity determination unit connected to said first voice analysis unit for continuously comparing said first frame signal to a predetermined set of standard signals and generating a similarity signal indicative of a degree of similarity between said first frame signal and one of said standard signals, said similarity determination unit cumulating said similarity signal over a plurality of said frames so as to generate a cumulative similarity signal;

a second voice analysis unit connected to said voice input unit for generating a second frame signal indicative of a second feature for a corresponding one of said frames;

an end portion control unit connected to said second voice analysis unit for continuously cumnulating said second frame signal corresponding to a predetermined combination from a set consisting of a beginning portion and an ending portion of said standard signals and said similarity signal over a plurality of said frames in said similarity determination unit, said similarity determination unit generating a cumulative similarity signal; and a speech confirmation unit connected to said similarity determination unit for confirming said frames as speech based upon said cumulative similarity signal and for generating a speech confirmation signal.

19. The system for recognizing speech according to claim 18 wherein said first voice analysis unit utilizes a word spotting technique.

20. The system for recognizing speech according to claim 18 wherein said similarity determination unit includes a state transition model.

21. The system for recognizing speech according to claim 18 wherein said second feature is a likelihood for being an end point.

22. The system for recognizing speech according to claim 21 wherein said said second frame signal increases a total similarity signal value for a frame with a likelihood for being the end point so that said frame is more likely selected as an end point using an end point free pattern matching.

23. The system for recognizing speech according to claim 21 wherein said second voice analysis unit generates said second frame signal including an intensity signal which is indicative of intensity of an i th one of said frames and is designated by p(i), said p(i) is defined by log based of said intensity at said i th one of said frames.

24. The system for recognizing speech according to claim 21 wherein said second frame signal includes a differential intesity signal which is indicative of differential intensity of an ith one of said frames and is designated by Δp(i) said Δp( being defined by a difference between p(i) at p(i−1).

25. The system for recognizing speech according to claim 23 wherein said second frame signal is a penalty value tat becomes larger as said intensity becomes smaller.

26. The system for recognizing speech according to claim 24 wherein said second frame signal is a penalty value that becomes larger as said differential intensity becomes smaller for said beginning portion and as said differential intensity becomes larger for said ending portion.

27. The system for recognizing speech according to claim 23 wherein said p(i) at the beginning frame of said frames is designated by $P_S(i)$ and said p(i) at the end frame of said frames is designated by $P_E(i)$, said $P_S(i)$ and $P_E(i)$ being determined by a following set of relationships:

$$p_2 \leq p(i) \quad \rightarrow P_{S/E}(i) = 0$$

$$p_1 \leq p(i) < p_2 \quad \rightarrow P_{S/E}(i) = -P_p(p_2 - p(i))/(p_2 - p_1)$$

$$p(i) < p_1 \quad \rightarrow P_{S/E}(i) = -P_p$$

where $p_1$, $p_2$ and $p_p$ are predetermined constants.

28. The system for recognizing speech according to claim 24 wherein said Δp(i) at the beginning frame of said frames is designated by $P_S(i)$, said $P_S(i)$ being determined by a following set of relationships:

$$p_2 \le \Delta p(i) \quad \rightarrow P_S(i) = 0$$

$$p_1 \le \Delta p(i) < p_2 \quad \rightarrow P_S(i) = -P_p(p_2 - \Delta p(i))/(p_2 - p_1)$$

$$\Delta p(i) < p_1 \quad \rightarrow P_S(i) = -P_p$$

wherein $P_1$, $P_2$ *and* $P_p$ are predetermined constants.

29. The system for recognizing speech according to claim 24 wherein said Δp(i) at the end frame of said frames is designated by $P_E(i)$, said $P_E(i)$ being determined by a following set of relationships:

$$-p_2 \ge \Delta p(i) \quad \rightarrow P_E(i) = 0$$

$$-p_1 \ge \Delta p(i) > -p_2 \quad \rightarrow P_E(i) = -P_p(p_2 - \Delta p(i))/(p_2 - p_1)$$

$$\Delta p(i) > -p_1 \quad \rightarrow P_E(i) = -P_p$$

wherein $p_1$, $p_2$ and $p_p$ are predetermined constants.

30. The system for recognizing speech according to claim 18 wherein said similarity determination unit continuously cumulates said similarity signal until said cumulative similarity signal reaches a second predetermined threshold value.

31. The system for recognizing speech according to claim 18 wherein said first frame signal includes melcepstrum.

32. The system for recognizing speech according to claim 31 wherein said first voice analysis unit determines said melcepstrum under a predetermined set of conditions including said predetermined frame length of 20 millisecond and mel-scaling parameter of 0.5.

33. The system for recognizing speech according to claim 31 wherein said first frame signal further includes a duration-based state transition signal.

34. A system for recognizing speech, comprising:

a voice input unit for inputting input voice data having a plurality of frames, each of said frames having a predetermined frame length;

a first voice analysis unit connected to said voice input unit for continuously generating a first frame signal for each of said frames, said first frame signal being indicative of a first feature of a corresponding one of said frames;

a similarity determination unit connected to said first voice analysis unit for continuously comparing said first frame signal to a predetermined set of standard signals and generating a similarity signal indicative of a degree of similarity between said first frame signal and one of said standard signals, said similarity determination unit cumulating said similarity signal over a plurality of said frames so as to generate a cumulative similarity signal;

a second voice analysis unit connected to said voice input unit for generating a second frame signal for each of said frames, said second frame signal being indicative of a second feature of a corresponding one of said frames;

an end portion control unit connected to said second voice analysis unit for continuously cumulating said second frame signal corresponding to a predetermined combination from a set consisting of a beginning portion and an ending portion of said standard signals and said similarity signal over a plurality of said frames so as to generate said similarity signals; and a recognition unit connected to said end portion control unit for recognizing said frames as speech based upon said cumulative similarity signal, said recognition unit generating a match signal after a predetermined time after said frames are determined as speech.

35. A recording medium containing a computer program for instructing speech recognition, the computer program comprising the steps of:

a) converting input voice data into digital data having a plurality of frames, each of said frames having a predetermined frame length;

b) continuously generating first frame data for each of said frames, said first frame data being indicative of a first feature of a corresponding one of said frames;

c) continuously comparing said first frame data to a predetermined set of standard data and generating similarity data indicative of a degree of similarity between said first frame data and one of said standard data;

d) continuously cumulating said similarity data over a plurality of said frames so as to generate a cumulative similarity data;

e) continuously generating a second frame data indicative of a second feature of a predetermined number of said frames situated substantially near a predetermined combination from a set consisting of a beginning portion and an ending portion;

f) generating a total similarity data based upon said cumulative similarity data and said second frame data; and g) recognizing said frames as speech based upon said total similarity data.

36. The recording medium according to claim 35 wherein said portion as recited in said step e) includes a predetermined number of selected ones of said frames, said selected ones of said frames being situated substantially near an end of a series of said frames.

37. The recording medium according to claim 35 wherein said portion includes a predetermined number of selected ones of said frames, said selected ones of said frames being situated substantially near a beginning of a series of said frames.

38. The recording medium according to claim 35 wherein said portion includes a predetermined number of selected ones of said frames, some of said selected ones of said frames being situated substantially near an end of a series of said frames and others of said selected ones of said frames also being situated substantially near a beginning of said series of said frames.

39. The recording medium according to claim 35 wherein said second frame data includes intensity data which is indicative of intensity of an i th one of said frames and is designated by p(i), said p(i) is defined by log based of said intensity at said i th one of said frames.

40. The recording medium according to claim 39 wherein said second frame data includes a differential intensity data which is indicative of differential intensity of an ith one of said frames and is designated by Δp(i), said Δp(i) being defined by a difference between p(i) and p(i−1).

41. The recording medium according to claim 39 wherein said second frame data is a penalty value that becomes larger as said intensity becomes smaller.

42. The recording medium according to claim 40 wherein said second frame data is a penalty value that becomes larger as said differential intensity becomes smaller for said beginning portion and as said differential intensity becomes larger for said ending portion.

43. The recording medium according to claim 39 wherein said p(i) at the beginning frame of said frames is designated by $P_S(i)$ and said p(i) at the end frame of said frames is designated by $P_E(i)$, said $P_S(i)$ and $P_E(i)$ being determined by a following set of relationships.

$$\begin{aligned} p_2 \le p(i) &\rightarrow P_{S/E}(i) = 0 \\ p_1 \le p(i) < p_2 &\rightarrow P_{S/E}(i) = -P_p(p_2 - p(i))/(p_2 - p_1) \\ p(i) < p_1 &\rightarrow P_{S/E}(i) = -P_p \end{aligned}$$

where $p_1$, $p_2$ and $p_p$ are, predetermined constants.

44. The recording medium according to claim 40 wherein said Δp(i) at the beginning frame of said frames is designated by $P_S(i)$, said $P_S(i)$ being determined by a following set of relationships:

$$\begin{aligned} p_2 \le \Delta p(i) &\rightarrow P_S(i) = 0 \\ p_1 \le \Delta p(i) < p_2 &\rightarrow P_S(i) = -P_p(p_2 - \Delta p(i))/(p_2 - p_1) \\ \Delta p(i) < p_1 &\rightarrow P_S(i) = -P_p \end{aligned}$$

wherein $P_1$, $P_2$ and $P_p$ are predetermined constants.

45. The recording medium according to claim 40 wherein said Δp(i) at the end frame of said frames is designated by $P_E(i)$, said $P_E(i)$ being determined by a following set of relationships:

$$\begin{aligned} -p_2 \ge \Delta p(i) &\rightarrow P_E(i) = 0 \\ -p_1 \ge \Delta p(i) > -p_2 &\rightarrow P_E(i) = -P_p(p_2 - \Delta p(i))/(p_2 - p_1) \\ \Delta p(i) > -p_1 &\rightarrow P_E(i) = -P_p \end{aligned}$$

wherein $p_1$, $p_2$ and $p_p$ are predetermined constants.

46. The recording medium according to claim 35 wherein said step d) is continuously performed until said cumulative similarity data in said step d) reaches a second predetermined threshold value.

47. The recording medium according to claim 35 wherein said step g) compares said total similarity data to a third predetermined threshold value.

48. The recording medium according to claim 47 wherein said g) further comprising an additional step of h) repeating at least said steps b) through d) for a predetermined time after said frames are determined as speech for confirmation.

49. The recording medium according to claim 35 wherein said first frame data includes melcepstrum.

50. The recording medium according to claim 49 wherein said melcepstrum is determined under a predetermined set of conditions including said predetermined frame length of 20 millisecond and mel-scaling parameter of 0.5.

51. The recording medium according to claim 49 wherein said first frame data further includes a duration-based state transition data.

* * * * *